United States Patent [19]

Gigliotti, Jr. et al.

[11] Patent Number: 4,589,471

[45] Date of Patent: May 20, 1986

[54] METHOD FOR RAPID SOLIDIFICATION OF TITANIUM ALLOYS BY MELT EXTRACTION

[75] Inventors: Francis X. Gigliotti, Jr., Scotia; Lee C. Perocchi, Schenectady; Peter G. Frischmann, Saratoga, all of N.Y.

[73] Assignee: General Electric Company, Schenectady, N.Y.

[21] Appl. No.: 665,901

[22] Filed: Oct. 29, 1984

[51] Int. Cl.[4] ..... B22D 11/00

[52] U.S. Cl. ..... 164/463; 164/462

[58] Field of Search ..... 164/423, 429, 463, 479, 164/462; 420/417, 421

[56] References Cited

U.S. PATENT DOCUMENTS 3,896,203 7/1975 Maringer et al. ..... 164/463

4,149,884 4/1979 Maringer et al. ..... 164/463

FOREIGN PATENT DOCUMENTS 55342 7/1982 European Pat. Off. ..... 164/423

1054 12/1979 PCT Int'l Appl. ..... 164/463

*Primary Examiner*—Nicholas P. Godici

*Assistant Examiner*—Richard K. Seidel

*Attorney, Agent, or Firm*—Paul E. Rochford; James C. Davis, Jr.; Paul R. Webb, II

[57] ABSTRACT

A method of melt extraction of titanium alloys is provided. The alloys are those containing a high concentration of titanium and a significant amount of an alloying element selected from the group consisting of molybdenum, tantalum and columbium. Surprisingly, the extraction process is rendered feasible when the surface of the extracting mechanism is of molybdenum.

6 Claims, 3 Drawing Figures

METHOD FOR RAPID SOLIDIFICATION OF TITANIUM ALLOYS BY MELT EXTRACTION

BACKGROUND OF THE INVENTION

The present invention relates to methods and means by which titanium alloys can be prepared. More specifically, it relates to a method of preparing rapidly solidified titanium alloys through a melt extraction technique.

Processing titanium metal in the liquid phase is difficult because of the extraordinary degree to which titanium will dissolve almost any other material. It is very difficult to find a container for pure titanium or titanium having relatively low percentage of the order of 15 to 20% of other ingredients. Except for processes such as arc melting of titanium metal in a chilled crucible, until the present time, it has not been possible to contain liquid titanium within a heated solid container without attack and dissolution of at least a part of the substance of the container taking place. One way in which pure titanium or titanium alloy having very high concentration of titanium (i.e. less than 20% of other ingredients) has been processed from the liquid phase is through melt extraction. The melt extraction process results in formation of ribbon or thread of rapidly solidified alloys of titanium. Rapidly solidified titanium alloys have properties which are distinct from the same composition prepared in bulk melt form by more conventional processing.

One mode of melt extraction involves preparing a crucible to contain the titanium and heating only the center portion of the titanium contained within a crucible to the molten state. The edge of a rotating wheel is then brought into contact with the molten titanium and a filament is formed as a small quantity of titanium freezes onto and temporarily adheres to the edge of the spinning wheel.

The titanium in the crucible is molten only at the center and thus the container for the molten titanium is additional titanium which remains solid.

It is known that the rotating disks which are used for rapid solidification of pure titanium and of certain of its alloys by the melt extraction process described above perform poorly in this process. For certain alloys of titanium, particularly those with higher concentrations of titanium, and which contain significant amounts of molybdenum, columbium and tantalum, it has not been feasible to prepare large quantities of rapidly solidified material because the process has been catastyrophically interrupted by a failure of the rotating disk to continue to function. During the rapid solidification processing runs, the filament of such titanium alloys suddenly fails to separate spinning disk. Following such initial irreversible adherence, a thick layer of the titanium alloy rapidly builds up on the disk. The material on the disk edge continues to accrete and digs deeper and deeper into the melt in the crucible. This effectively interrupts the rapid solidification process inasmuch as the filament does not separate from the disk. It has been observed for some such alloys that only small quantities of filament are prepared before such adherence of the alloy to the disc effectively interrupts the process.

For some of the alloys of titanium and particularly those having higher content of other alloying elements the process is not interrupted so rapidly and larger quantities of filament can be made on a repeated basis. The problem which has remained, however, is to find some scheme by which melt extraction of the titanium alloys containing significant amounts of at least one metal selected from the group consisting of molybdenum, columbium and tantalum can be accomplished on a continuous basis. To date, this has not been feasible.

Numerous attempts have been made to establish and to improve on the melt extraction process. Early efforts were made by Robert Maringer, Carroll Mobley and co-workers at the Battell-Columbus Laboratories. The essence of the technique which was developed by these individual was to contact a pool of open metal with a rotating disk. The disk was intended to drag off a thin layer of metal from the pool so that the removed metal freezes to the disk but also detaches from the disk and both phenomena occur almost simultaneously. The edge of the disk which contacted the molten pool was typically tapered with an angle of about 60° to about 120° so that a relatively thin edge of the spinning wheel came into contact with the molten metal. These prior art efforts involved forming a continuous wire-type product through use of a smooth edge disk and also involved forming a discontinuous wire or staple-type of product by use of a disk having notches spaced around the rim which contacts the molten metal.

Two principal types of melt extraction have been described by Maringer and his co-workers. The first is a crucible melt extraction in which a molten pool of metal is contained within a crucible and the extraction disk is located above the pool and rotates in a vertical plane. See FIG. 1 attached. A brushing contact of the edge of the extraction disk with the surface of the pool leads to the disk dragging off the thin layer of metal from the pool as explained above. A second type of melt extraction also described by Maringer is the pendant drop melt extraction. According to this process, a stick of metal to be converted to rapidly solidified fine wire or filament is oriented vertically and the bottom end of the stick is melted by directing an electron beam against the end or by induction heating or similar technique. In this pendant drop melt process, the wheel is located below the stick and it rotates in a vertical plane as in the crucible melt extraction process. See FIG. 2 attached for an illustration of apparatus as used in this pendant drop process.

Some aspects of the melt extraction process are described by Maringer et al in several patents and publications. In U.S. Pat. No. 3,838,185, entitled FORMATION OF FILAMENTS DIRECTLY FROM MOLTEN MATERIAL, Maringer et al describe the crucible melt extraction process. In this patent, there is no discussion of this specific disk material or of desired properties of this material. However, there is a caution and the discussion of disk particulars that column 7, lines 8–21 and on lines 39–63, emphasizing the need to prevent the edge of the disk from getting so hot that the melt extraction process ceases. Thermal conductivitity and the shape of the disk edge are described. The disk materials are disclosed and the examples are copper and aluminum.

In a related patent of Steward et al, U.S. Pat. No. 3,812,901, entitled METHOD OF PRODUCING CONTINUOUS FILAMENTS FROM A ROTATING HEAT-EXTRACTING MEMBER, the crucible melt extraction process is described. Also described is a method of generating a tension on the wire product after solidification. In the examples, a brass disk is disclosed as having been used to melt extract aluminum, a nickel disk to extract HADFIELD steel, a copper disk to extract cast iron, and an aluminum disk to extract low carbon steel. Disk material is not described as of critical significance.

In U.S. Pat. No. 3,861,450, entitled AN IMPROVED METHOD OF FORMATION OF FILAMENT DIRECTLY FROM MOLTEN MATERIAL, Mobley et al. described using a protective atmosphere around a crucible melt extraction disk to prevent sticking. A problem of metal sticking to the wheel occurred and is reported in the patent but the problem is not associated with the composition of the wheel material. The disks used in their examples are water cooled copper and water cooled composite disks of aluminum and copper.

In U.S. Pat. No. 3,871,439, entitled METHOD OF MAKING FILAMENT OF SMALL CROSS-SECTION, Maringer et al. described a method of crucible melt extraction in which the extraction disk is a cylinder with the helical thread on its periphery. The disk materials disclosed are aluminum and copper.

In U.S. Pat. No. 3,896,203, entitled CENTRIFUGAL METHOD OF FORMING FILAMENTS FROM AN UNCONFINED SOURCE OF MOLTEN MATERIAL, Maringer et al. describe the pendant drop melt extraction process. The patentees state that the disk material "need not be of any special material" but advise that it have a high heat capacity or a high thermal conductivity or alternatively that it be internally cooled. See column 6, lines 2–12. The patentees further state that the invention works with heat extraction disks of copper, aluminum, nickel, molybdenum, and iron. See column 6, lines 12–14. The examples described copper disks used to melt extract tin, aluminum oxide, 304 stainless steel, iron alloy N-155, titanium, and columbium. A cooled rolled steel disk was used to melt extract chromium and 304 stainless steel. A molybdenum disk was used to extract bulk columbium.

In U.S. Pat. No. 3,904,344, entitled APPARATUS FOR FORMATION OF DISCONTINUOUS FILAMENTS DIRECTLY FROM MOLTEN MATERIAL, Maringer et al. describe crucible melt extraction in which the disk which is employed has notches formed in its melt touching surface. The result is the production of discontinuous product by the spin casting of the material. The inventors state that the disk material choice and design are not critical. See column 7, lines 11–18. In the four examples presented, the use of a copper disk is disclosed.

In U.S. Pat. No. 4,154,284, entitled METHOD FOR PRODUCING FLAKE and in U.S. Pat. No. 4,242,069, entitled APPARATUS FOR PRODUCING FLAKE, Maringer describes a refinement in disk design in order to permit a discontinuous product to be made. Notching of the disk for use either in crucible melt extraction or in pendant drop melt extraction is disclosed. In the examples, a brass disk is employed for extracting 304 stainless steel, zinc and titanium alloy Ti-6Al-4V. A table identifies copper and A-6 steel as the material of other disks.

The crucible melt extraction and the pendant drop melt extraction processes are described in an article entitled "Casting of Metallic Filament and Fiber", appearing in the Journal of Vacuum Science Technology, vol. 11, No. 6 November/December 1974, pages 1071–1076. In this report, the authors state that "disk materials of a wide variety have been used, including aluminum, copper, various steels, brass, nickel, and molybdenum." They also state that "Fibers have been cast successfully with all disk materials tried." The same general observations on the wide range of suitable wheel materials for use in the crucible melt extraction and pendant drop melt extraction processes was also affirmed in an article entitled "The Melt Extraction of Metallic Filaments and Staple Fiber" by R. E. Maringer et al. in the American Institute of Chemical Engineers Supposium Series, Vol. 74, No. 180 (1978) pages 16–19.

The pendent drop melt extraction process has been used to make quantities of a ribbon of the titanium alloy Ti-6Al-4V and this is reported in an article entitled "Preparation and Properties of Compacts of Melt Extracted Staple Fibers of Ti-6Al-4V Alloy". This article is authored by R. E. Maringer et al. and appears in the American Institute of Chemical Engineers Symposium Series, Vol. 74, No. 180 (1978) pages 111–116. The amounts of the alloy processed through the melt extraction process was sufficient for consolidation and for mechanical testing. The wheel materials employed were copper and brass.

In the literature and prior art references described and reported above, there is no report of the problems which we have encountered in the melt extraction of titanium alloys having a high percentage content of titanium in addition to at least one metal selected from the group consisting of molybdenum, columbium and tantalum.

Further, there is no report in any of his prior art literature of any solution to the problem of the melt extraction of titanium alloys containing rare earths and containing significant amounts of molybdenum, columbium and tantalum, and having a high concentration of titanium.

BRIEF SUMMARY OF THE INVENTION

One object of the present invention is to provide a melt extraction process which can successfully extract essentially all alloys of titanium.

Another object is to provide an apparatus for the melt extraction of a wide variety of titanium alloys.

Another object is to provide a method for melt extracting of titanium alloys of high titanium content on a continuous basis over a period of time to permit the making of a substantial quantity of the product of the melt extraction.

Another object is to provide a method for melt extraction of titanium containing molybdenum, columbium and tantalum.

Another object is to provide a method for melt extraction of titanium alloys which are strongly adherent to conventional metals.

Other objects will be in part apparent and in part pointed out in the description which follows.

In one of its broader aspects, objects of the invention can be achieved by providing a method for melt extraction of highly adherent titanium alloys including alloys of titanium containing significant levels of molybdenum, columbium and tantalum which comprises providing a melt of the alloy to be extracted in a casting zone, introducing a rapidly rotating wheel of molybdenum into the melt in the zone with the wheel rotating continuously, and continuing to supply molten metal to the wheel in the zone and continuing to extract molten metal from the zone and continuously separating the extracted metal from the wheel. Such highly adherent titanium alloys may also contain rare earth additions and these alloys can also be successfully melt extracted to rapidly solidified thread or ribbon.

BRIEF DESCRIPTION OF THE DRAWINGS

The description of the invention which follows will be better understood by reference to the accompanying drawings in which.

DETAILED DESCRIPTION OF THE INVENTION

It has been found that there is a strong effect of alloy chemistry on the yield of material which is melt extraction cast from the alloy. For example, we have found that the alloy Ti-6Al-4V can be melt extracted by a variety of disks formed of different materials.

However, it has also been found that the melt extraction processing of titanium alloys containing significant quantities of one or more of the refractory metals, columbium, tantalum and molybdenum, is very difficult. This is particularly true where the melt also contains a rare earth ingredient.

Further, we have found that the melt extraction of the alloy Ti-6Al-4Zr-2Sn-2Mo which alloy contains a rare earth or yttrium additive, cannot be successfully melt extracted by prior art processes. We have also found that titanium alloys containing a high concentration of titanium, of more than 60 weight percent, as well as a refractory metal selected from the group consisting of molybdenum, tantalum and columbium cannot be melt extracted by prior art processing or apparatus.

Figure 1:
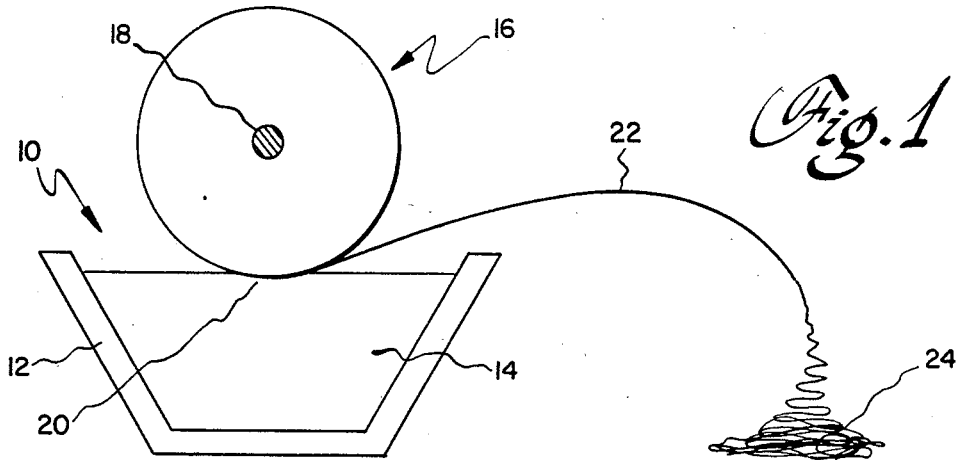
FIG. 1 is a schematic diagram of crucible metal extraction apparatus.

Reference is made now to FIG. 1 which is a schematic illustration of a prior art conventional crucible melt extraction apparatus. The crucible 10 has a wall 12 of refractory material and contains a melt of suitable metal 14. The melt is heated by means not shown.

A casting wheel 16 rotates on an axis 18 and makes a brushing contact with the surface 20 of the metal of the bath 14. A small amount of metal is carried by the wheel from the bath and it forms a thread or ribbon 22 and, when operated on a continuous basis, leaves a deposit 24 of such thread or ribbon of the metal of the bath 14. The combination of elements as taught in the present application can be employed in extracting molten titanium compounds containing a high concentration of titanium and containing a significant concentration of molybdenum, tantalum or columbium. This particular group of alloys are alloys which are not known to be otherwise extractable as from a melt in a crucible such as 14 of FIG. 1. The present invention can be used in combination with apparatus as illustrated in FIG. 1 to extract such alloys on a continuous basis.

Figure 2:
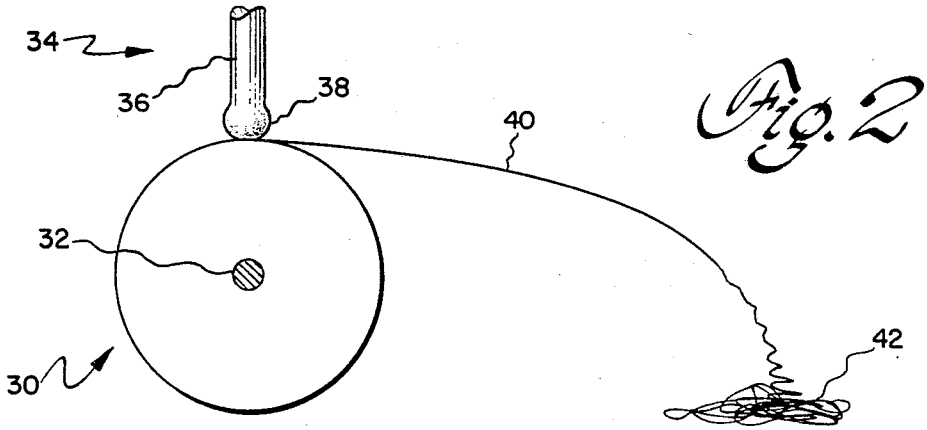
FIG. 2 is a schematic illustration of a pendant drop metal extraction apparatus.

Turning next to FIG. 2, there is illustrated in a schematic fashion, the essentials needed for practice of the melt extraction by the conventional prior art pendant drop extraction method. In this apparatus, the casting wheel 30 is rotated on an axis 32. A rod of metal of desired composition 34 is mounted over wheel 30 and its lower end 36 is continuously melted to form a pendant drop 38 by a means such as an electron beam or laser beam not shown. The placement of the rod 34 is adjustable vertically by means not shown to bring the pendant drop 38 into contact with the edge of wheel 30. Alternatively, the wheel may be supported in a movable fashion and the wheel edge may be moved into the drop. Contact of the wheel edge with the molten drop 38 results in a thread 40 of the metal of rod 34 being cast and being separated from the wheel. When casting on a continuous basis, a collection 42 of the thread can be made.

When apparatus such as described with reference to FIG. 2 is employed in the pendant drop melt extraction of a titanium alloy which contains a highly adherent combination of constituents such as a high level content of titanium together with a metal selected from the group consisting of tantalum, molybdenum and columbium, the casting can be carried out successfully by employing the combination of materials as provided pursuant to the present invention. In this respect, the apparatus described with reference to FIG. 2 can be employed in the practice of the present invention. However, the present inventors are not aware of any other way to melt extract the titanium alloys containing high concentrations of titanium together with a significant concentration of at least one ingredient selected from the group consisting of molybdenum, tantalum and columbium, i.e. other than the method of the present invention.

Figure 3:
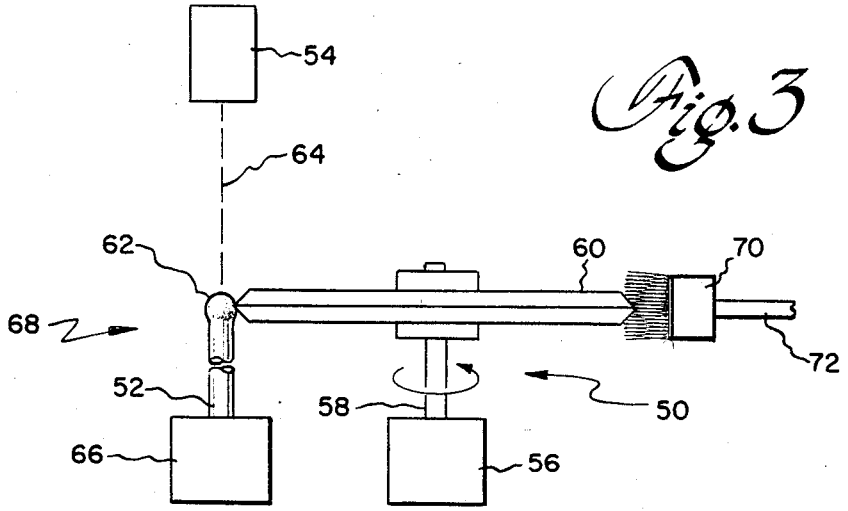
FIG. 3 is a schematic illustration of a melt extraction process as provided according to the present invention.

Reference is made now to FIG. 3 of the drawings. An apparatus is illustrated for a process of melt extraction on a continuous basis from a rod. The rod is positioned vertically and its top is melted. In a typical operation, a wheel between about six and eight inches in diameter is positioned horizontally to have its edge touch the melt as it rotates at a rotary speed between 1700 and 1800 revolutions per minute. A copper alloy brush 10 held in place by support 72 brushes against the wheel edge at a position diametrically opposite to where the melt is contacted.

Referring now again to FIG. 3 which is a schematic illustration of an apparatus as may be used in the practice of the present invention. A wheel mechanism 50 is used in connection with a rod of material 52 and a heat source 54. The wheel mechanism 50 includes an actuator 56, a shaft 58 driven by the actuator 56 and a wheel 60 attached to shaft 58 and driven in turn by the shaft. As is evident from the figure, the wheel 60 is held in horizontal orientation and its rotation axis is vertical and aligned with shaft 58.

The rod 52 is also vertically oriented and is heated at its upper end 62 by a suitable source of heat. In the illustration of FIG. 3, such a source 54 may be a laser or an electron beam or similar source of high energy radiant heating or alternatively it may be some other source of high energy to be delivered to the end 62 of rod 52. The dashed line 64 represents the path of the energy incident on the end 62 of rod 52. A means 66 may be provided for advancing rod 52 into the melting and casting zone 68. In this way a continuous casting mechanism is provided. A copper alloy brush, indicated schematically at 70, may be held against the edge of wheel 60 at a position diametrically opposite to where the wheel contacts the melt 62 as indicated above.

EXAMPLES 1 THROUGH 19

The following is a Table of examples of melt extraction experiments performed in an effort to develop an effective and efficient process and apparatus.

The apparatus employed is that illustrated in and described with reference to FIG. 3.

TABLE A

| Ex. | Disk Matl. | Alloy Cast | Results |
|---|---|---|---|
| 1 | Titanium | Ti—2.8Ni—3.5Cu | Poor. Material built up in layers on wheel |
| 2 | Inconel 600 | Ti—4.81Al—2.71Zr—2.35Sn—5.37Ta—2.23Er | Poor. Material stuck to disk at once |
| 3 | Tool steel | Ti—5.13Al—2.89Zr—2.51Sn—0.95Sc | Poor. Material stuck to disk at once |
| 4 | Yellow Brass | Ti—6Al—4V | Good. Much material cast before onset of sticking |
| 5 | Yellow Brass | Ti—5.13Al—2.89Zr—2.51Sn—0.95Sc | Fair. Cast small amount before sticking |
| 6 | Yellow Brass | Ti—6Al—4Zr—2Sn—2Mo—1Er | Poor. Material stuck to disk at once |
| 7 | Yellow Brass | Ti—4.96Al—2.8Zr—2.42Sn—1.9Cb—2.3Er | Poor. Very small amount cast before sticking |
| 8 | Red Brass | Ti—6Al—4V | Good. Much material cast. No sticking |
| 9 | Red Brass | Ti—4.96Al—2.8Zr—2.42Sn—1.9Cb—2.3Er | Good. Much material cast before sticking |
| 10 | Red Brass | Ti—4.81Al—2.71Zr—2.35Sn—5.37Ta—2.23Er | Poor. Material stuck to disk at once |
| 11 | Red Brass | Ti—6Al—4Zr—2Sn—2Mo—2Er | Poor. Material stuck to disk at once |
| 12 | Copper | Ti—6Al—4V | Good. Much material cast. No sticking |
| 13 | Copper | Ti—6Al—4Zr—2Sn | Good. Much material cast. No sticking |
| 14 | Copper | Ti—6Al—4Zr—2Sn—2Mo—2Nd | Poor. Material stuck to disk at once |
| 15 | Molybdenum | Ti—6Al—4V | Good. Much material cast. No sticking |
| 16 | Molybdenum | Ti—4.96Al—2.8Zr—2.42Sn—1.9Cb—2.3Er | Good. Much material cast before puddle fell over |
| 17 | Molybdenum | Ti—5.13Al—2.89Zr—2.51Sn—0.95Sc | Good. Much material cast before sticking |
| 18 | Molybdenum | Ti—4.86Al—2.74Zr—2.37Sn—5.43Ta—1.2Y | Good. Much material cast. No sticking |
| 19 | Molybdenum | Ti—6Al—4Zr—2Sn—2Mo—2Er | Good. Much material cast. Very slight sticking |

With reference to the examples listed in Table A, we have found that there is a strong effect of alloy chemistry on the castability of various alloys by means of casting wheels of different metal composition.

For example, the alloy Ti-6Al-4V listed in Example 4 above is readily castable in high yield and using disks of a number of different materials. In Example 4 the material is yellow brass. In Example 8 the same alloy was cast on red brass. In Example 12 the same alloy was cast on copper and in Example 15 the same alloy was cast on molybdenum.

However, alloys containing a high concentration of titanium of 60% or more by weight and containing at least one refractory metal selected from the group consisting of columbium, tantalum and molybdenum are more difficult to cast and the material of the wheel which is employed in the casting has been discovered to be quite critical. For example, our experience from the numerous tests conducted including those listed in Table A above teaches us that the alloy Ti-6Al-4Zr-2Sn-2Mo, which contains a rare earth or yttrium can be cast to a rapidly solidified fiber on a continuous basis only with a molybdenum extraction disk. In this regard, note that the alloy Ti-6Al-4Zr-2Sn-2Mo-2Er was successfully cast in Example 19 to obtain good results with much cast material being produced and with very slight sticking. However, in Example 14, an attempt to cast the same alloy using a copper wheel gave poor results with the material sticking to the copper disk at once. Similarly, an attempt made by Example 11 to cast the same alloy on a red brass disk gave poor results with the cast material sticking to the disk at once. Similarly, an effort to cast essentially the same alloy in Example 6 demonstrated that yellow brass is a poor choice for a disk material inasmuch as poor results were obtained and the cast material stuck to the disk at once.

Referring now to Example 17 of the Table, it is evident that the casting of an alloy containing Ti-5.13Al-2.89Zr-2.51Sn-0.95Sc resulted in good casting when a molybdenum casting wheel was employed. Much cast material was obtained before some sticking occurred.

By contrast, an effort to cast this same material on a casting wheel of tool steel as described in Example 3 resulted in poor casting with the material sticking to the disk at once.

With further reference to Table A and the results reported in the Table, it is evident that in Example 2 an effort to cast an aloy containing Ti-4.81Al-2.71Zr-2.35Sn-5.37Ta-2.23Er was unsuccessful when a casting wheel of Inconel 600 was employed. The poor results were attended by the material sticking to the disk at the start of the casting period.

By contrast and from an examination of Example 18, this tantalum-containing alloy was cast employing a molybdenum casting wheel. Good results were observed in Example 18 with much material being cast and no sticking occurring.

The superior performance of molybdenum as a casting material of the casting wheel for the casting of the alloys as set out in the examples, especially when compared to steel as well as to copper and its alloys, was quite surprising. The teachings of the prior art, and particularly that of Marginger and his coworkers was that high thermal conductivity and/or high heat capacity measured as specific heat were the important attributes for a disk material. If the Marginger prior art teaching were valid, then copper and brasses should have been found to be superior to molybdenum. However, quite the reverse was the actual finding of the examples of Table A, particularly when applied to alloys containing a high percentage of titanium and a significant percentage of molybdenum, tantalum or columbium or a combination of these materials. The thermal properties of some materials employed in the tests of Table A are listed in Table B.

TABLE B

Thermal Properties of Disk and Related Materials

| Alloy | Thermal Conductivity W/meter-deg K) | Heat Capacity (J/kg-deg K) |
|---|---|---|
| Ti—6Al—4V | 7.3 | 548 |
| Tool Steel | 28.3 | 460 |
| Inconel 600 | 15 | 456 |
| Copper | 393 | 384 |
| Yellow Brass | 116 | 380 |
| Red Brass | 188 | 380 |
| Molybdenum | 131 | 271 |

The inventors herein have no knowledge or understanding of why the molybdenum casting material was found to be so superior in the casting of alloys having a high concentration of titanium and a significant concentration of at least one metal selected from the group consisting of tantalum, columbium and molybdenum. However, the experimental results confirm that this is the case.

Compositions containing as high as 3.7 wt % of tantalum and a high concentration of titanium have been successfully melt extracted using a molybdenum casting wheel.

A significant concentration of a metal selected from the group consisting of molybdenum, tantalum and columbium is a concentration above trace concentrations and which is effective to promote adhesion of the titanium alloy containing the metal to casting wheels other than molybdenum casting wheels. Such significant concentration can be determined by simple experiments. The concentrations of these metals in the alloys of the examples are significant concentrations.

In considering the relative merits of different melt extraction processes, a significant factor is the extent of extraction or casting which can be accomplished with a particular process. Some prior art processes refer to casting but do not distinguish a process which can be used for melt extraction only instantaneously from a process which can be operated continuously.

By continuous operation as used with reference to melt extraction is meant a process which operates without such adhesion of melt to casting wheel as to result in catestrophic failure of the process. As is evident from the data of Table A, casting, according to the method of the present invention including the potential for continuous casting of alloys, has been demonstrated for alloys containing high concentrations of titanium, in excess of 40 weight percent titanium and preferably in excess of 60 weight percent of titanium and also containing significant concentrations of at least one element selected from the group consisting of molybdenum, tantalum and columbium. The result obtained in Example 7, for example, indicates that a casting method which employs yellow brass in melt extraction is operable for producing a very small amount of the titanium alloy containing columbium and erbium but that it is inoperable as a continuous process.

This result of Example 7 is contrasted with the results of Example 16. In Example 16, the potential for continuous operation of the casting process is demonstrated. We have found that a process such as that of Example 16 can be operated for several minutes and until the supply of casting rod is exhausted without catastrophic sticking. By catastrophic sticking as used herein is meant sticking which is not reversible by release of the material cast on the wheel while the casting process continues. Catastrophic sticking requires that the casting process be terminated because of continued build-up of cast material on the wheel. On an industrial scale, such sticking of very high temperature metal is potentially catastrophic of course.

We have discovered that it is possible to melt extract on a continuous basis alloys of titanium which are not otherwise melt extractable on a continuous basis. The continuous process we have discovered is capable of extracting metal at rates of the order of 500 grams per hour and greater for each acretion edge. The wheels such as 16, 30 and 60 of the Figures have a single edge for contact with metal. However, it is feasible to provide wheels which have multiple side by side extraction edges and thereby to increase the extraction or casting capability of apparatus as illustrated in the Figures. Desirably, extraction wheels as provided pursuant to this invention may be internally cooled to enhance continuous operation of the extraction process.

By optimizing the continuous nature of the process as taught herein, substantial quantities of rapidly solidified alloys of titanium can be produced. Such substantial quantities, of the order of 15 or 20 kilograms, for example, can be consolidated into articles useful in high strength at high temperature applications such as aircraft engine parts.

Material can be prepared by the present process in fiber or ribbon form. By use of a suitably shaped segmented wheel edge the process can be employed to produce flake on a continuous basis.

It is principally the contact surface of a rapid solidification wheel which must be molybdenum in the practice of the present invention. Wheels having contact surfaces of molybdenum on a base of another metal such as copper may be employed in practice of the present invention.

What is claimed and sought to be protected by Letters Patent of the United States is as follows:

1. A method of continuously casting alloys of titanium which comprises providing an alloy containing a high concentration of titanium, a rare earth, and a significant percentage of at least one metal selected from the group consisting of molybdenum, tantalum and columbium, forming a melt of the alloy, providing a casting zone, casting the alloy by continuously accreting a small quantity of the melt from the molten zone onto a casting surface composed predominantly of molybdenum,, quickly and continuously separating the cast metal from the molybdenum surface, and furnishing molten alloy to the zone at a rate equivalent to that at which it is continuously removed by casting.

2. The method of claim 1 in which the selected metal is molybdenum.

3. The method of claim 1 in which the selected metal is tantalum.

4. The method of claim 1 in which the selected metal is columbium.

5. A method of continuously casting alloys of titanium which comprises providing an alloy containing at least 40% by weight of titanium, a rare earth and a significant percentage of at least one metal selected from the group consisting of molybdenum, tantalum and columbium, forming a melt of the alloy, providing a casting zone, casting the alloy by continuously accreting a small quantity of the melt from the molten zone onto a casting surface composed predominantly of molybdenum, quickly and continuously separating the cast metal from the molybdenum surface, and furnishing molten alloy to the zone at a rate equivalent to that at which it is continuously removed by casting.

6. A method of continuously casting alloys of titanium which comprises providing an alloy containing at least 60% by weight of titanium, a rare earth and a significant percentage of at least one metal selected from the group consisting of molybdenum, tantalum and columbium, forming a melt of the alloy, providing a casting zone, casting the alloy by continuously accreting a small quantity of the melt from the molten zone onto a casting surface composed predominantly of molybdenum, quickly and continuously separating the cast metal from the molybdenum surface, and furnishing molten alloy to the zone at a rate equivalent to that at which it is continuously removed by casting.

* * * * *

UNITED STATES PATENT AND TRADEMARK OFFICE

CERTIFICATE OF CORRECTION

PATENT NO. : 4,589,471

DATED : May 20, 1986

INVENTOR(S) : Gigliotti, Jr. et al.

It is certified that error appears in the above-identified patent and that said Letters Patent is hereby corrected as shown below:

ON THE PATENT COVER PAGE:

[75] Inventors: delete "Francis X. Gigliotti, Jr." and substitute therefor -- Michael F.X. Gigliotti, Jr. --

Signed and Sealed this

*Ninth* Day of *September 1986*

[SEAL]

*Attest:*

DONALD J. QUIGG

*Attesting Officer*

*Commissioner of Patents and Trademarks*